United States Patent [19]

Shoemaker et al.

[11] 4,154,475

[45] May 15, 1979

[54] WALL RECLINING ROCKING CHAIR

[75] Inventors: Edwin J. Shoemaker; William Pacitti; Marvin J. Baumann, all of Monroe, Mich.

[73] Assignee: La-Z-Boy Chair Company, Monroe, Mich.

[21] Appl. No.: 853,202

[22] Filed: Nov. 21, 1977

[51] Int. Cl.[2] ..... A47C 1/02

[52] U.S. Cl. ..... 297/83; 297/270; 297/DIG. 7

[58] Field of Search ..... 297/83, 270, 271, DIG. 7, 297/61, 68, 88, 89, 87, 85, 313; 267/112

[56] References Cited

U.S. PATENT DOCUMENTS

| | | | |
|---|---|---|---|
| Re. 29,483 | 11/1977 | Re | 297/88 |
| 366,741 | 7/1887 | Sands | 297/87 |
| 871,263 | 11/1907 | Flindall | 297/269 |
| 908,986 | 1/1909 | Flindall | 297/313 |
| 1,766,840 | 6/1930 | Rose | 297/277 |
| 1,821,299 | 9/1931 | Ferreira | 297/328 |
| 1,903,918 | 4/1933 | Fraser et al. | 297/87 X |
| 2,110,979 | 12/1937 | Smith | 57/12 |
| 2,270,172 | 1/1942 | Ruegger | 297/329 |
| 2,313,023 | 3/1943 | Ruegger | 297/329 |
| 2,834,397 | 5/1958 | Kluglein et al. | 297/68 |
| 3,096,121 | 7/1963 | Knabusch | 297/369 |
| 3,098,646 | 7/1963 | Knabusch et al. | 267/112 |
| 3,856,346 | 12/1974 | Herman | 297/61 |
| 4,057,289 | 11/1977 | Jones | 297/270 X |
| 4,072,342 | 2/1978 | Johnson | 297/88 X |
| 4,077,663 | 3/1978 | Cycowicz | 297/83 |

*Primary Examiner*—James T. McCall

*Attorney, Agent, or Firm*—Harness, Dickey & Pierce

[57] ABSTRACT

A reclinable chair is rockable on a frame which is movable forwardly on a base. The chair and frame are supported on the base on a pair of facing channels which slope downwardly from the rear to the front of the base. The frame and base are locked together in the rear and forward positions, the lock at the rear being released when the activating handle for the legrest at the side of the chair is raised 10° or 15°. The further movement of the handle extends the legrest forwardly of the seat. The seating of the occupant in the chair assists in the movement of the chair to the forward position during which a spring between the frame and base is tensioned for returning the chair to the rear position when the occupant leaves the seat and permits the springs of the seat to move upwardly and release the front latch. A lever prevents the rocking of the chair until it reaches the forward position where it is stopped in its forward movement to release the chair for rocking. When in forward position, the back of the chair may be reclined and the legrest may be extended in which position a ratchet mechanism becomes effective to prevent the chair from rocking or tilting forwardly.

10 Claims, 8 Drawing Figures

WALL RECLINING ROCKING CHAIR

BACKGROUND OF THE INVENTION

The patent to Re' U.S. Pat. No. Re. 28,210 shows a chair which moves from a wall when the back is reclined toward the wall. U.S. Pat. No. 3,096,121 of the present assignee shows a legrest mechanism which when in forward position locks the chain agains rocking. U.S. Pat.No. 3,525,549, assigned to the present assignee, discloses a recling chain in which the back is tiltable backwardly as the seat is moved forwardly and upwardly. The patent shows slides at the edges of the back which permits it to be removed for compact shipment. The composite of these patents are incorporated in the structure of the present disclosure. Assignee's U.S. Pat. No. 2,863,495 discloses two back frames with springs therebetween which moves one frame relative to the other under certain conditions somewhat similar to the movement of the frame and base of the present rocking chair relative to each other.

BRIEF DESCRIPTION OF THE DRAWINGS

FIG. 8 is a broken view of the structure illustrated in FIG. 2 when the back of the chair is reclined moving the seat forwardly and upwardly.

DESCRIPTION OF THE PREFERRED EMBODIMENT

Figures 1, 2, 3, 5:
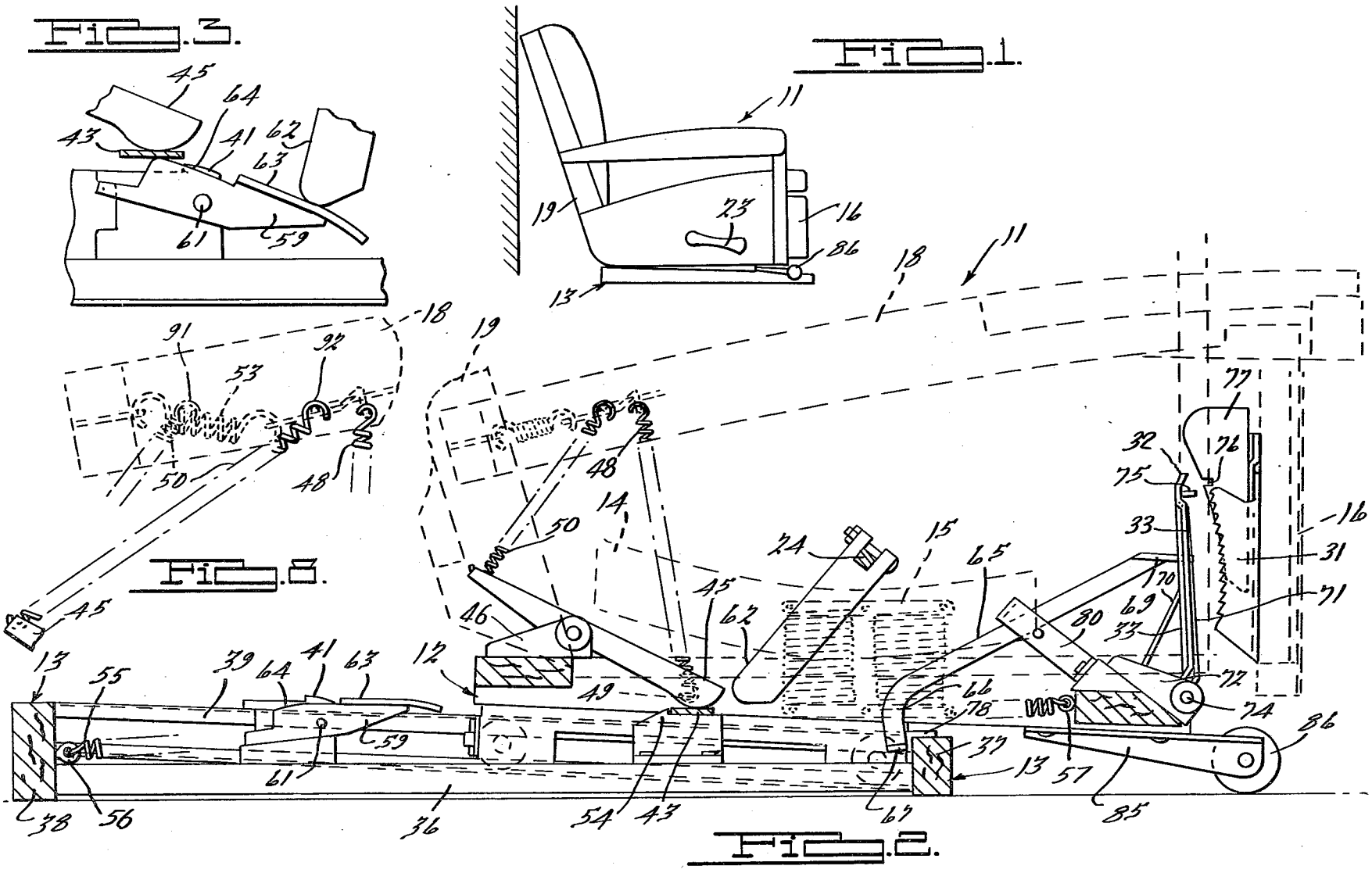
FIG. 1 is a view of a chair which is rockable when moved forwardly which embodies the features of the present invention.
FIG. 2 is a sectional view of the chair illustrated in FIG. 1 when moved forwardly away from a wall in rocking position.
FIG. 3 is a view of the latch which retains the chair and frame in rearward position on the base with the latch shown in released position.
FIG. 5 is a sectional view of the structure illustrated in FIG. 7, taken on the line 5—5 thereof.
Figures 4, 5:
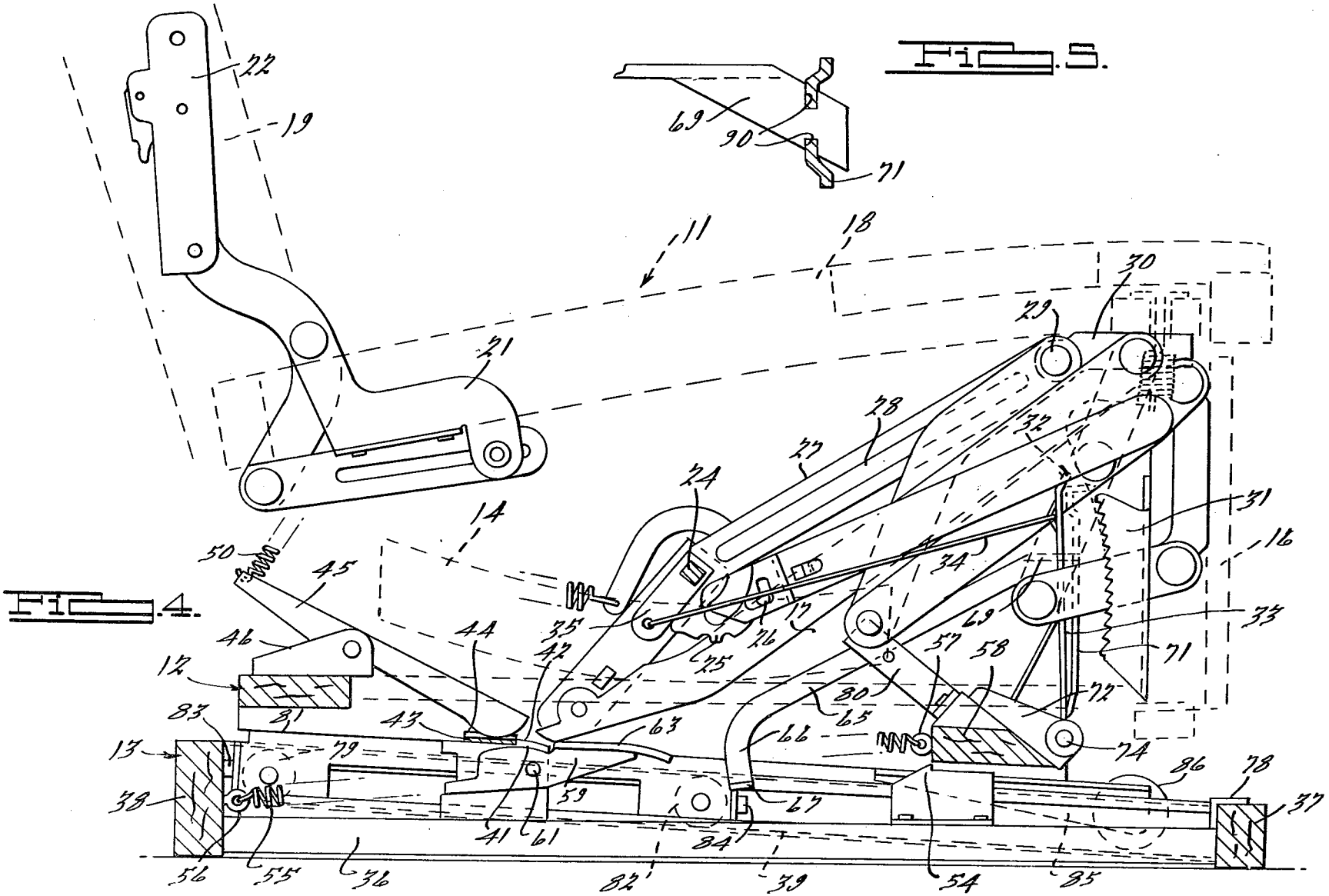
FIG. 4 is a sectional view of the chair illustrated at FIGS. 1 and 2 when in rearward position.

Referring to the drawings, a chair 11 is mounted on a sub-frame 12 which is supported on a base frame 13. The chair 11 has a pair of rocker blocks 14 which rock upon the sub-frame 12 to which it is connected by a pair of coiled springs forming a unit 15 on each side of the chair. This is shown in assignee's U.S. Pat. No. 3,096,121 along with the mechanism which operates a legrest 16 which is extended by links 17 forwardly of a seat 18 which moves upwardly and forwardly when the back 19 is tilted rearwardly. This relative movement between the back and the seat is obtained by the link mechanism 21 which is disclosed in assignee's U.S. Pat. No. 3,525,549 which has slidable supports 22 which are secured to opposite sides of the back 19 to permit the back to be removed from the link mechanism and placed upon the seat for compact shipment.

A handle 23 at the righthand side of the frame operates a square shaft 24 to actuate the links 17 to extend or retract the legrest 16. A notched link 25 on the shaft 24 is engaged by a detent 26 for securing the legrest 16 in two additional forward positions and is illustrated, described and claimed in assignee's U.S. Pat. No. 3,325,210. A pair of straps 27 having a reinforcing central offset 28 therein is secured by a pivot 29 to a bracket 30 at the front of the chair along with one end of a legrest link to brace the ends of the shaft 24 which rotates therein. The front of the chair carries a toothed bracket 31 which is engaged by an end 32 of a pivoted latch 33 which is normally retained out of engagement with the teeth of the bracket 31 by a looped spring wire 34 secured to an arm 35 which contains a square aperture which engages the square shaft 24 to be operated thereby. If when the legrest is extended, the chair is rocked, the end 32 of the latch 33 engages one of the teeth of the tooth bracket 31 to prevent the chair from rocking or tilting forwardly. While most of the above is old in the various assignee's patents, they are combined to produce the present chair which has additional features for locking the chair and sub-frame at their rear and forward positions on the base frame 13 with a lever which prevents the rocking of the chair at all points except when at its forward position illustrated in FIG. 2.

Figure 7:
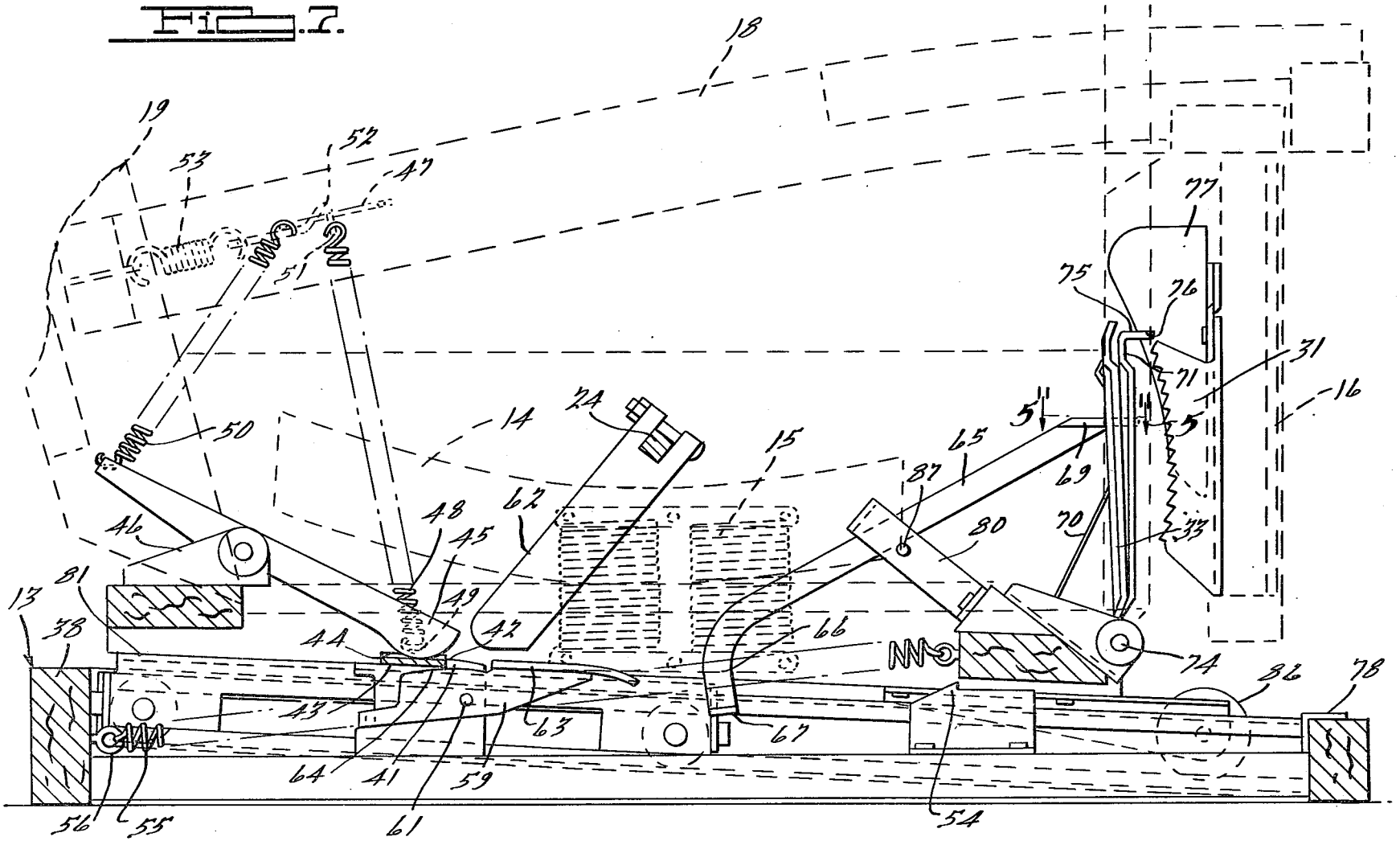
FIG. 7 is a view of the structure illustrated in FIG. 2 with the chair in rear non-rockable position.

The base frame 13 has side elements 36 and forward and rearward cross members 37 and 38 with inwardly presented channel elements 39 secured to the side elements 36. The channel elements 39 have a substantial forward and downward slope which assists in the forward movement of the chair and sub-frame when occupied and when the rear locking mechanism is released. The locking mechanism embodies a notched bracket 14 which has a nib 42 against which a cross strap 43 engages. The cross strap 43 is loosely supported at each end in notches 44 on the underface of the sub-frame 12 and is urged downwardly by gravity or by flexing. A lever 45 is pivoted on a bracket 46 and stressed by a coiled spring 50 which is hooked over the end of a sinuous spring strip 47, a plurality of which forms the spring surface of the seat 18, as illustrated in FIG. 7. The lever 45 is utilized for a purpose to be explained hereinafter.

A coil spring 48 has the bottom end secured to a loop 49 on the cross strap 43 and its upper end secured in an aperture in the end 51 of a strap 52 which anchors the end of the sinuous spring straps on the plurality of coil springs 53 secured to the rear of the seat, as illustrated in assignee's U.S. Pat. No. 3,098,646. The coil spring 48, when the seat is unoccupied, has sufficient strength to raise the cross strap 43 from a notched bracket 54 disposed at the front of the base frame 13 which is employed to retain the chair 11 in forward position. The coiled springs 48 and 50 become weakened as the sinuous spring strips 47 are deflected when the seat is occupied and will provide sufficient strength to the spring 48 when the seat is unoccupied to bow or lift the cross strap 43 upwardly sufficient to be released from the notch of the bracket 54 at the front of the sub-frame 12 to permit the sub-frame to be moved to its rear locked position. This movement is produced by a coil spring 55 which has the rear end secured by an eye screw 56 to the rear cross member 38 and the front end engaged to an eye screw 57 which is secured to a cross member 58 at the front of the sub-frame 12 on which the chair rocks.

For releasing the cross strap 43 from the notched bracket 41 at the rear of the base, a lever 59 is pivoted at 61 to the base to be operated by a finger 62 which has a square slot in the upper end which is secured over the square shaft 24. When the shaft is rotated counterclockwise, the end of the finger 62 contacts a flange 63 on the lever 59 which is moved downwardly to have a cam surface 64 in engagement with the cross strap 43 to move the strap upwardly from engagement with the nib 42 of the bracket 41. This swings the flange 63 downwardly and releases the sub-frame 12 on which the chair rocks so that the sub-frame and chair can move forwardly until the cross strap 43 engages the notch of the bracket 54 to prevent the sub-frame 12 from returning to its rear position.

During this forward movement, the coiled spring 55 is further tensioned for returning the frame and chair to its original rear locked position. The chair is prevented from being rocked in all positions except in its frontmost position by a lever 65 which has a downwardly extending end 66 which is flanged outwardly at the end to form a stop 67. If the occupant of the chair so desires, the unit may be used as a back-and-forth glider operating between the brackets 41 and 54 prior to disengagement for the rocking action. It will be noted that the cross member 58 supports an inverted U-shaped bracket 80 within which the link 65 is carried on a bolt 87 on which it may slide. The opposite end of the lever 65 has a flange 69 equipped with aligned edge slots 90 which, when extended through a slot in a latched member 71, is secured thereto at all times, as illustrated in FIG. 5. The latching member 71 is mounted on a pivot carried by a bracket 72, a pair of which is supported upon the cross member 58. The other bracket supports the latch 33 on a pivot 74. An L-shaped member 70 of spring steel engages the latching member 71 and urges it toward the bracket 77.

Figure 6:
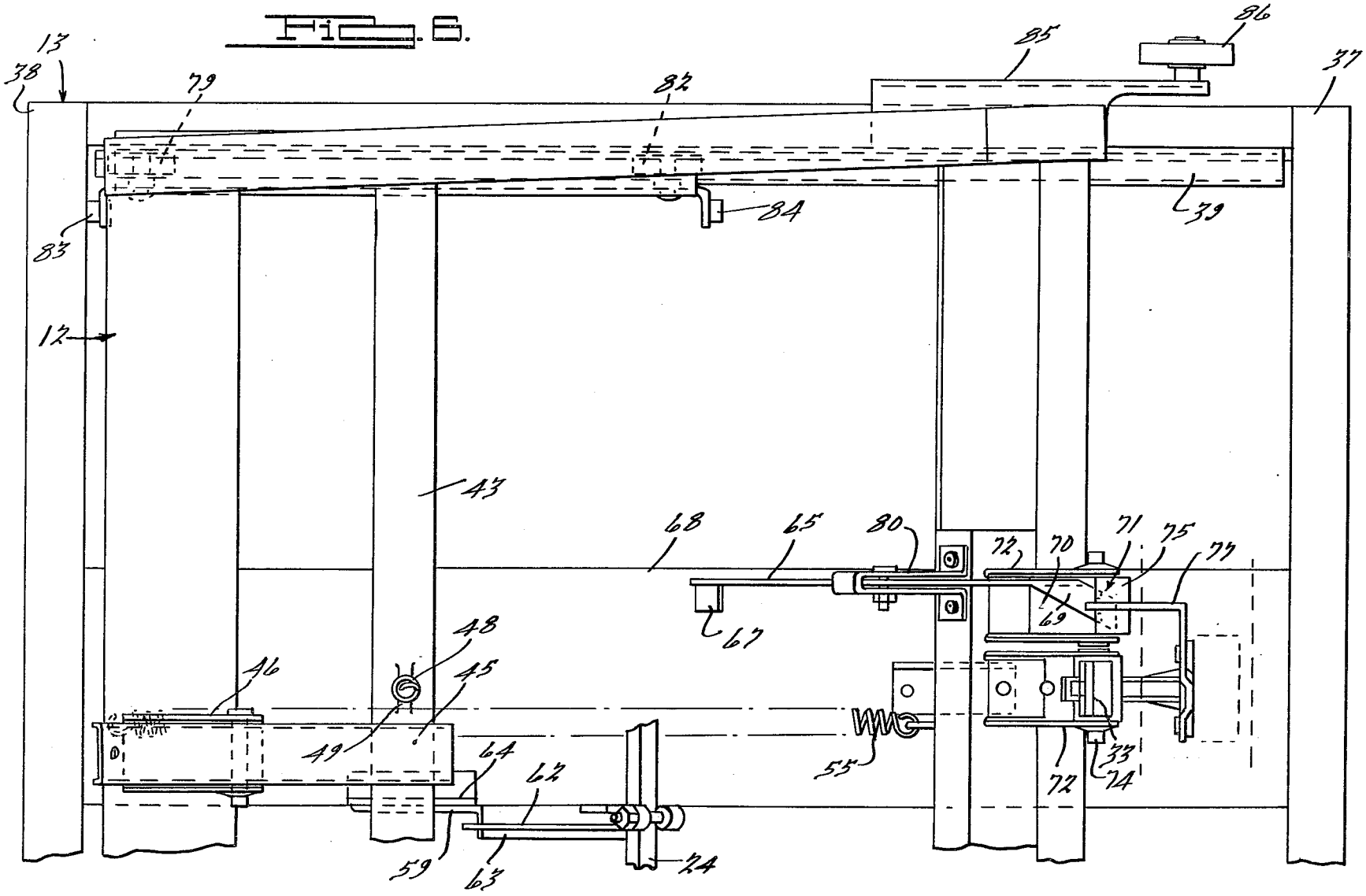
FIG. 6 is a plan view of the base, with the chair and platform removed, showing the lefthand side thereof.

During the movement of the chair 11 and sub-frame 12 forwardly, the lever 65 rests on the bolt 87 and maintains a finger 75 on the end of the latching member 71 within a slot 76 in the bracket 77 which is secured to the front of the chair frame along side of the toothed bracket 31, as illustrated in FIGS. 6 and 7. When the end 66 of the lever 65 strikes a bumper member 78 on the cross member 37 of the base frame 13, it will be prevented from moving further to the right and will tilt the latching member 71 away from the bracket 77 to move the finger 75 from the slot 76 and permit the chair to rock as long as it is retained latched in the forward position. In this position, the back may be reclined and the legrest 16 extended. When this occurs, the end 32 of the latch 33 engages a tooth of the bracket 31 and prevents the rocking of the chair. The reclining of the back 19 moves the seat 18 forwardly moving the end of the spring 50 from the position 91 to the position 92 thereby stretching the spring and applying a pull to the outer end of the lever 45. This applies a pressure at the opposite end of the lever on the cross strap 43 and provides assurance that the cross strap will be additionally locked within the notch of the bracket 54. When the back is returned to sitting position, the spring 50 will no longer apply pressure to the cross strap 43 when at the front of the base frame within the notch of the bracket 54 so that after the handle 23 is turned to return the legrest to nested position, the movement of the occupant from the seat 18 will permit the sinuous spring strips 47 to return to their normal position applying tension to the spring 48 which will move the cross strap 43 upwardly and out of the notch of the bracket 54. The tension in the spring 55 will return the chair 11 and sub-frame 12 to their rear locked position with the cross strap 43 within the notch of the bracket 41. In this position, the back 19 of the chair 11 is closely adjacent to the wall and is prevented from being rocked by the lever 65.

A roller 79 is secured to the rearward end of a bracket 81 and a roller 82 is secured to the forward end of the bracket with the brackets 81 secured to opposite ends of the frame 12 and disposed within the channels 39. A stop member 83 at the rear end strikes the forward face of the rear cross member 38 to limit the rearward movement of the sub-frame 12 and a stop member 84 at the front end of the sub-frame 12 strikes the forward cross member 37 of the base frame 13 to accurately locate the forward position thereof. A bracket 85 is carried by the underside of the sub-frame 12 at the front corners thereof, each supporting a wheel 86 which will engage the floor forwardly of the base frame 13 to prevent the tilting of the base frame when the chair is rocked.

What is claimed is:

1. In a wall reclining rocking chair, a base frame, a sub-frame, a rocker chair embodying a back and seat mounted on said sub-frame, means on said base frame sloping downwardly at the forward end on which said sub-frame is supported for forward movement by the weight of the occupant, lock means on said base frame for securing said sub-frame and rocker chair in rearward and forward positions, means for releasing said lock means at the rearward position when the seat is occupied, means for releasing said lock means at the forward position when the seat becomes unoccupied, means for returning said rocker chair and sub-frame to the rear position upon the seat becoming unoccupied, and means for preventing the rocking of the rocker chair both forwardly and rearwardly in all but its locked forward position.

2. In a wall reclining rocking chair as recited in claim 1, wherein a legrest supported on linkage means is operated by a shaft which is journaled in the chair frame and actuated by a handle at the side of the chair, and a finger on said legrest shaft for releasing said locking means at the rearward position of the rocker chair when the handle is slightly raised.

3. In a wall reclining rocking chair as recited in claim 1, wherein said locking means is a loosely mounted cross strap on the bottom of the sub-frame extending between the sides thereof, and a notched bracket on the base at the rearward and forward positions which are engaged by said cross strap.

4. In a wall reclining rocking chair as recited in claim 3, wherein said seat has sinuous spring units which deflect downwardly when occupied, said locking means being released from the notched bracket at the forward position when the weight of the occupant is removed from the seat permitting the sinuous spring units to move upwardly and raise the cross strap from the notched bracket.

5. In a wall reclining rocking chair as recited in claim 1, wherein the means for preventing the rocking of the rocker chair is a slot in a bracket in which one end of a pivoted latching member extends, said bracket being mounted at the front of the rocker chair, a link having one end pivoted to said latching member with the other end spaced from said base frame, and a member on said base frame for stopping the advancement of said link when the rocker chair is substantially in its forward position for withdrawing the latching member from said slot in said bracket to permit the rocker chair to rock.

6. In a wall reclining rocking chair as recited in claim 1, wherein the rocker chair back is pivotably connected to a seat which is advanced forwardly and upwardly when the back is reclined in the forward latched position of the rocker chair.

7. In a wall reclining rocking chair as recited in claim 6, wherein an extendable legrest is provided at the front of the chair, and a ratchet mechanism provided on the front of the rocker chair becomes effective when said legrest is extended and the chair is in forward position to prevent the chair from tilting forwardly or rocking.

8. In a wall reclining rocking chair as recited in claim 6, wherein a cross strap is carried by said chair at the underside thereof, a lever pivoted between its ends has an end engageable with the cross strap when the chair is locked in forward position, and a coil spring at the other end of said lever having its remote end secured to the seat so as to be moved forwardly to have the engageable end exert a pressure on said lever when the back is reclined to apply further pressure to the cross strap to maintain it in locked position.

9. In a wall reclining rocking chair as recited in claim 3, wherein the releasing means at the forward position embodies a coil spring having an end secured to the cross strap and the opposite end secured to the seat to be stressed upwardly when the seat is unoccupied for raising the cross strap from the securing bracket.

10. In a wall reclining rocking chair as recited in claim 9, wherein a pivoted lever has one end engageable with the cross strap when in forward locked position with a spring on the opposite end of the lever which is secured to the seat to be stretched thereby when the back is reclined and the seat is moved forwardly to apply a second holding force to the strap in its forward latched position.

* * * * *